US007114594B2

(12) United States Patent
Rossignol et al.

(10) Patent No.: US 7,114,594 B2
(45) Date of Patent: Oct. 3, 2006

(54) DOOR FRAME OF A SHAFT DOOR WITH A CONTROL ARRANGEMENT FOR AN ELEVATOR SHAFT AND METHOD FOR ACCESS TO A CONTROL UNIT

(75) Inventors: Eric Rossignol, Dietwil (CH); Arnaud Collin, Schüpfheim (CH); Andreas Dorsch, Ascona (CH); Martin Rogger, Rotkreuz (CH)

(73) Assignee: Inventio AG, Hergiswil (CH)

( * ) Notice: Subject to any disclaimer, the term of this patent is extended or adjusted under 35 U.S.C. 154(b) by 36 days.

(21) Appl. No.: 10/953,824

(22) Filed: Sep. 29, 2004

(65) Prior Publication Data

US 2005/0133313 A1 Jun. 23, 2005

(30) Foreign Application Priority Data

Sep. 29, 2003 (EP) ..... 03405703

(51) Int. Cl.
*B66B 13/24* (2006.01)

(52) U.S. Cl. ..... 187/336; 187/325; 187/314; 187/276; 187/414; 49/116; 49/120; 52/204.1

(58) Field of Classification Search ..... 187/247, 187/280, 314, 316, 380, 336, 340; 49/28, 49/116, 12; 52/127.8, 204
See application file for complete search history.

(56) References Cited

U.S. PATENT DOCUMENTS 6,336,523 B1 * 1/2002 Ozeki et al. ..... 187/391

FOREIGN PATENT DOCUMENTS

| | | | |
|---|---|---|---|
| EP | 0 680 921 | | 11/1995 |
| EP | 0680921 | * | 11/1995 |
| EP | 0985626 | | 3/2000 |
| EP | 0985627 | | 3/2000 |
| EP | 1 016 614 | | 7/2000 |
| EP | 1 319 626 | | 7/2003 |
| EP | 1319626 | * | 7/2003 |
| JP | 02127837 | | 5/1990 |
| WO | WO 03/072478 | * | 9/2003 |

* cited by examiner

*Primary Examiner*—Kathy Matecki
*Assistant Examiner*—Stefan Kruer
(74) *Attorney, Agent, or Firm*—Butzel Long

(57) ABSTRACT

An elevator shaft door frame incorporates a control arrangement for an elevator installation including a control unit. The control unit is fixed in a chamber of a frame element of the door frame. The chamber communicates with an outside opening in the door frame, which opens at a floor, and is closed with a cover. The cover can be moved from the closed position by demounting to a service position in which access to the chamber is free. In addition, the door frame has an inside opening to the chamber which is accessible from the elevator shaft.

12 Claims, 2 Drawing Sheets

DOOR FRAME OF A SHAFT DOOR WITH A CONTROL ARRANGEMENT FOR AN ELEVATOR SHAFT AND METHOD FOR ACCESS TO A CONTROL UNIT

BACKGROUND OF THE INVENTION

The present invention relates to a door frame of a shaft door with a control arrangement for an elevator shaft, as well as to a method for access to a control unit.

A control arrangement in the sense of the present invention substantially comprises a control unit and means for mounting and protecting the control unit. The control unit in turn substantially comprises subassemblies required for control and/or regulation of the elevator installation. Moreover, such a control unit can contain interfaces and input modules necessary for servicing the elevator installation and for diagnosis. The control unit accordingly has to be accessible for the purpose of servicing or maintenance of the elevator installation.

Previously the control unit of an elevator installation was usually accommodated, together with the drive of the elevator installation, in a separate space or region, since such a control unit was, depending on the respective form of construction, relatively large.

A separate space is superfluous with present-day elevator systems, since the drive is frequently arranged in the elevator shaft itself. In the case of elevator installations of that kind the control unit is advantageously disposed in a region of an elevator shaft closure. European patent document EP 0 680 921 discloses a corresponding arrangement of a control unit in the wall of an elevator shaft. This arrangement demands a large space, since a control box is attached to the shaft door frame. Since this control box is usually needed on only one floor, this necessitates special constructional and aesthetic solutions for this floor. This is made possible inter alia by the fact that present-day control units are smaller and power consumption as well as generated heat could be reduced and thus, for example, space-consuming ventilating installations are not required.

The prior art control unit is preferably accommodated in the door frame, in a chamber. Such a chamber is formed by, for example, a door frame element of the shaft door, usually by a vertical door post element. The door post element has walls which bound the chamber. One of these walls has an outside opening which opens outside the elevator shaft and thus at the floor. The wall of the door frame element having this outside opening lies substantially parallel to the door leaves of the shaft door. The same wall generally also has a passage in which a floor panel is arranged by way of which the users of the elevator system can call the elevator car.

It is disadvantageous that the door frame element with the incorporated control unit visually differs from the door frame elements of the remaining floors not requiring control units and that different built-in floor panels result. A solution for placement of the control unit that would make it possible at the same time to use the same floor panel on all floors would be desirable.

PCT patent application WO 03/072478 shows a corresponding incorporation of energy supply units in a door frame. The energy supply units are accessible for maintenance, from the floor, via a pivotable lid. A disadvantage of this arrangement is that the openings, which are to be provided, in the door frame are executed to be large so that all work, such as, for example, replacement of apparatus, can be undertaken via these openings. This again requires a cover of large size, which is costly and unattractive.

The control unit itself is not visible when the elevator installation is in normal operation. It is disposed in its operational position. Access to the control unit is required within the scope of service or maintenance operations. If within the scope of service operations at the elevator installation there has to be access to the control of the elevator installation, the control unit is brought into a service position. The control unit has to be visible in this state and the actions required for servicing of the elevator installation, such as, for example initialization of travel commands, interrogation of state data or actuation of switches, has to be able to be carried out. If more extensive maintenance operations, such as, for example, replacement of components of the control unit, are required an appropriate degree of access has to be ensured. The difference between service operations and maintenance operations resides in the fact that for the purpose of the service a limited access to the control unit is required and no greater space for that purpose is necessary. Thereagainst, within the scope of maintenance of the control unit in certain circumstances parts have to be replaced, for which purpose a correspondingly large access space is necessary.

The outside opening of the chamber can be closed by a cover. The cover can, for example, be pivotable in the manner of a door leaf. In an operational position the cover closes the outside opening and in a service position the cover frees the outside opening and thus access to the chamber of the control unit for the purpose of service and maintenance. In a known solution the control unit is, for example, connected with the cover of the outside opening and is pivoted in common therewith.

It is disadvantageous with this solution that such a cover is large and correspondingly visible, because the service and maintenance operations have to be carried out through the outside opening.

The following point is to be regarded as a further disadvantage. The control unit of the elevator installation is typically supplied with mains voltage or three-phase current. If the control unit is seated in a door frame with a pivotable cover or it is fastened at this cover the risk then exists of the mains cable being crushed and damaged. A danger is thereby created. In the most unfavorable case the door frame or the shaft door can be shorted to the mains voltage.

In addition, the use of special flexible cable and the associated connecting elements for the control unit increases costs.

SUMMARY OF THE INVENTION

Objects of the present invention are: to propose a door frame with a control arrangement of the kind stated in the introduction, with a control unit, which by comparison with conventional arrangements of the control units is simpler in maintenance and mounting, visually unobtrusive and economic in manufacture; and to provide a method for access to such a control unit in the door frame.

According to the present invention a control unit is arranged in the door frame or in a chamber of the door frame of shaft door of an elevator installation. The chamber has an outside opening by means of which the chamber is accessible from a floor. This outside opening allows access to the chamber and to the control unit arranged therein for the purpose of servicing. The outside opening is provided with a cover, which in the closed state prevents access to the control unit or in the open state—the service position of the cover—enables access to the control unit.

Advantageously the outside opening is arranged at a wall, which is arranged transversely to a door leaf of the shaft door, of the door frame. It is advantageous in that case that optimum utilization can be made of the size of the door frame and the associated cover can be mounted at a visually advantageous location.

The chamber has an inside opening by means of which the control unit is accessible from the interior of the elevator shaft. The inside opening is sufficiently large so that individual parts of the control unit or the entire control unit can be demounted and installed. The advantage of this embodiment is to be seen in that the outside opening and the associated cover can be kept small, whereby an advantageous visual form of the cover can be achieved. Moreover, no cable guides via moved parts are necessary, whereby the risk of jamming or cutting through feed lines is eliminated. Access for the purpose of service and maintenance is ensured in an optimum manner.

The door frame element in which the chamber for the control unit is disposed is preferably a vertical door element or a door post element. This is advantageous, since access to the door post element is possible in simple manner.

It has also proved to be advantageous to so construct the cover of the chamber that in the mounted state or in its operational position it is integrated in the wall of the door post element at best so that it lies flush with this wall. The cover and the control unit are thus integrated in visually unobtrusive manner.

With advantage, a floor panel is arranged at a wall of the door frame element which lies transversely to the wall in which the outside opening with cover is disposed. The floor panel is preferably disposed at the height region of the control unit.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
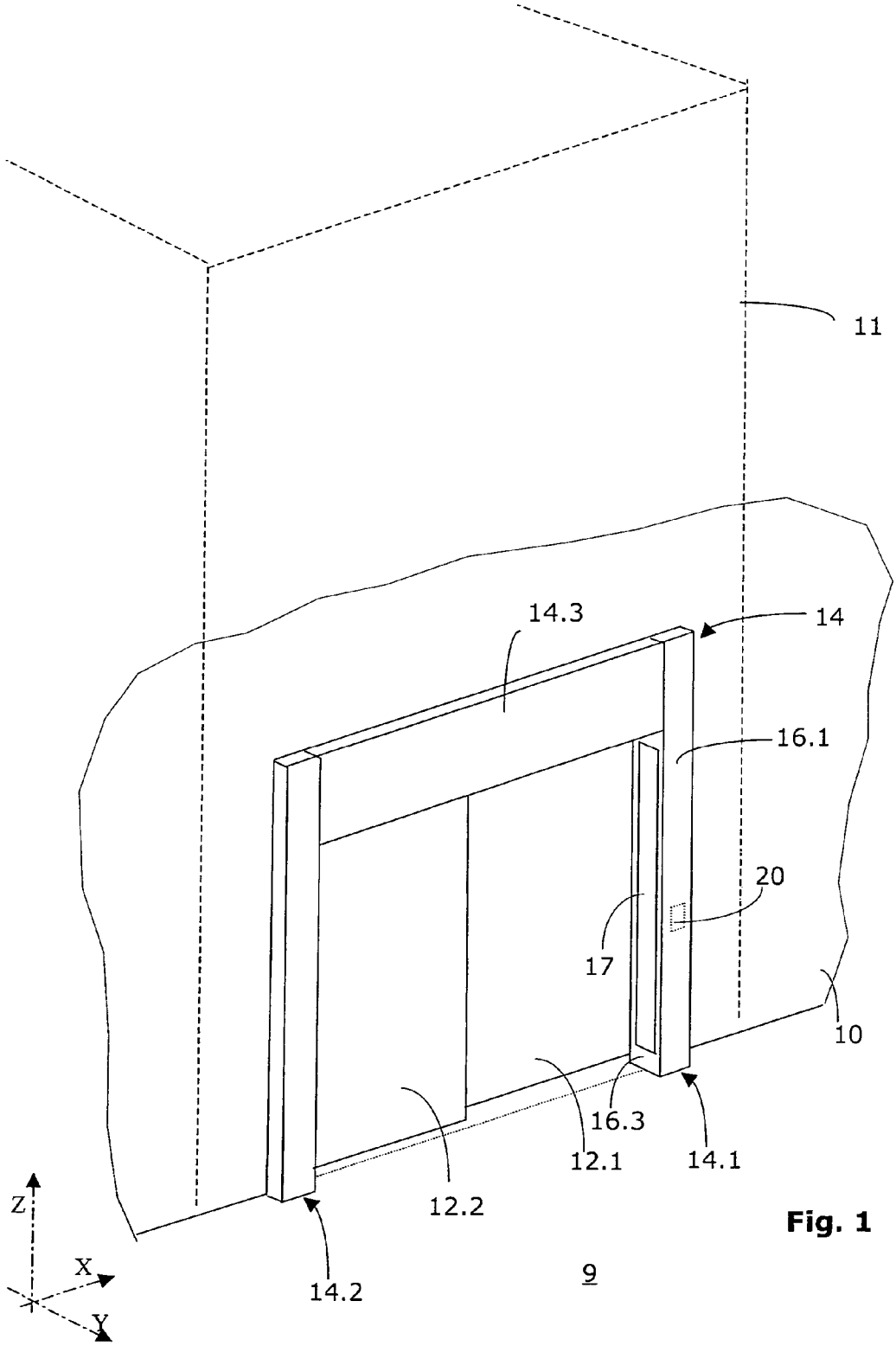
FIG. 1 is a schematic perspective view of an elevator shaft closure with a control arrangement according to the present invention.

The aspect of an elevator installation, as offered to a user thereof located on a floor 9, is illustrated in FIG. 1. A building, which is not further illustrated and in which the elevator installation is located, comprises a building wall 10 which bounds an elevator shaft 11 indicated in FIG. 1 by dashed lines.

The elevator shaft 11 is separated from the floor 9 visible in FIG. 1 by an elevator shaft closure. The elevator shaft closure comprises a shaft door which substantially consists of two door leaves 12.1, 12.2 and a door frame 14. The door leaves 12.1, 12.2 are horizontally displaceable and, in particular, in the direction of an axis "X" of an orthogonal three-dimensional co-ordinate system shown in FIG. 1 and with the further axes "Y" and "Z". The door frame 14 comprises three door frame elements, namely two lateral, vertical door frame elements 14.1, 14.2 which form door posts and are oriented parallel to the axis "Z", and an upper, horizontal door frame element 14.3 oriented parallel to the axis "X".

An inner chamber 16 (FIGS. 2 and 3) is formed by the vertical door frame element 14.1. The vertical door frame element 14.1 has several walls, particularly an outer front wall 16.1, an inner front wall 16.2 and an outer lateral wall 16.3. In the present example of an embodiment of the present invention the outer front wall 16.1 and the inner front wall 16.2 lie parallel to a plane formed by the axes "X" and "Z" and the outer lateral wall 16.3 lies parallel to a plane formed by the axes "Y" and "Z". The outer front wall 16.1 and the outer lateral wall 16.3 face the floor 9 and the inner wall 16.2 faces the interior of the elevator shaft 11.

The outer lateral wall 16.3 has an outside opening enabling access to the chamber 16. This outside opening can have any desired suitable size; in particular it can extend over the greatest part of the lateral wall 16.3 as indicated in FIG. 1.

The outside opening is closable by a cover 17. If the elevator installation is ready for operation or is in operation, then the cover 17 is mounted in its operational position in which it closes the outside opening. If the elevator installation is being serviced, then the cover 17 is in its service position, wherein it is completely demounted, i.e. without contact with the door frame element 14.1. Alternatively, the cover can also be fastened by means of a hinge (not shown). Accessibility is thereby slightly impaired, but the cover is now fastened to be secure against loss and the risk of damage is thereby reduced.

Figure 2:
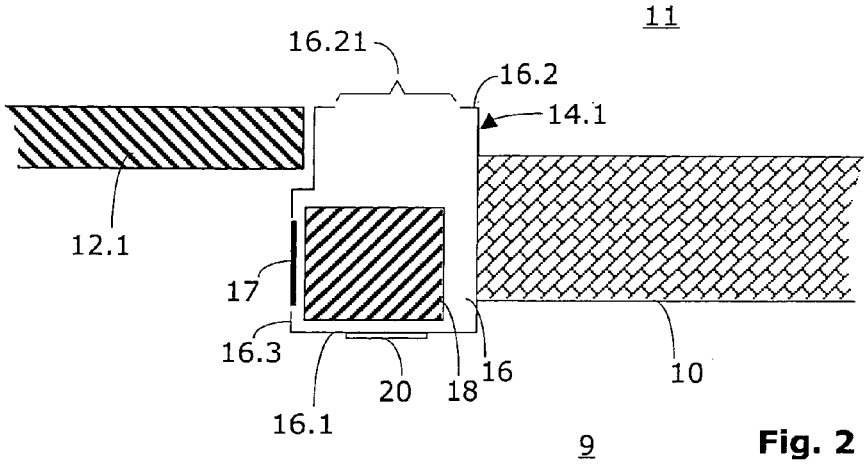
FIG. 2 shows a horizontal cross-sectional view of the control arrangement according to the present invention.

The cover 17 is preferably arranged to be coplanar or flush with the lateral outer surface 16.3, as shown in FIG. 2, whereby it is attached so as to be virtually vandal-proof and offers an aesthetically pleasing aspect.

A control unit 18 (FIGS. 2 and 3) of a control arrangement is arranged in a stationary position in the chamber 16. The control unit 18 remains in its position in the interior chamber 16 even when the cover 17 is demounted. It is thereby possible to avoid the need to provide movable (cable) connections as would be necessary if the control unit were mounted at the cover 17. As the control unit 18 there can be used a conventional control unit which is suitable from the viewpoints of installation size and thermal economy for installation in the door post 14.1.

In an advantageous form of embodiment of the present invention the control unit 18 comprises one or more of the following elements:

main current apparatus with connection to 400/230 V alternating voltage or another local voltage mains;

hardware and software of the elevator control (for example, the main computer with logic elements and interfaces);

telephone alarm system and/or intercom (for example, to enable a service call or emergency call to be placed); and apparatus used for emergency evacuation.

The control arrangement comprises, in addition to the control unit 18, the following:

fastening means for installation of the control unit 18 in the chamber 16;

cable for current supply and for creating the connections to the floor panel and for connecting with the drive of the elevator;

the cover 17;

an optional electrical or electromagnetic monitoring of the cover 17; and an optional lighting of the chamber 16.

The front outer wall 16.1 contains a passage in which a floor panel 20 is mounted, wherein preferably the same control panel can be used on all floors of the elevator installation.

The inner front wall 16.2 has an inside opening 16.21 which can be larger than the outside opening in the lateral wall 16.3, so that an optimum access to the control unit 18 is possible in order to undertake, for example, more extensive maintenance operations or, in a given case, exchange of the control unit 18. For that purpose the elevator car, which is not illustrated, can be moved to a suitable height between two floors in such a manner that an operative standing or crouching on the roof of the elevator car or on a work surface of the elevator car can carry out the necessary operations.

Figure 3:
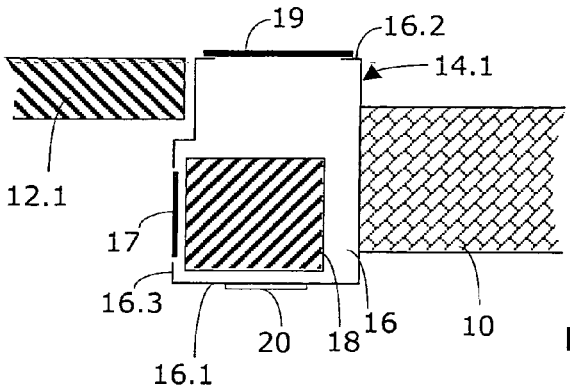
FIG. 3 shows a horizontal cross-sectional view of the control arrangement according to the present invention with a covered inside opening.

In a development, as shown in FIG. 3, the inside opening 16.21 of the inner front wall 16.2 is closable relative to the elevator shaft 11 by a cover 19. The cover 19 covers the inside opening 16.21 at least partly and thus protects the control unit 18 against dirt and accidental contact. Advantageously, the cover 19 is constructed at least partly of fire-retardant or fire-resistant material. If the elevator installation is ready for operation or in operation then the cover 19 is in its operational position and closes the inside opening 16.21. If the elevator installation is being serviced, then the cover 19 is in its maintenance position and access to the chamber 16 is free.

For maintenance of the control unit 18 an elevator car is moved between the floor 9 and the lower adjoining floor so that the roof of the elevator car or a work surface of the elevator car lies at a suitable working height. The energy feed to the elevator installation is then interrupted or the elevator installation is switched to a maintenance state and subsequently the door leaves 12.1, 12.2 are mechanically opened. An operative can now walk onto the roof or the work surface of the elevator car in order to remove the cover 19 and carry out the necessary maintenance operations.

In the case of a further form of embodiment of the present invention the control unit is divided into several parts which are respectively placed in the door frames of different floors. The placement of the parts is, however, carried out analogously to the arrangement shown in FIGS. 1 to 3.

Figure 4:
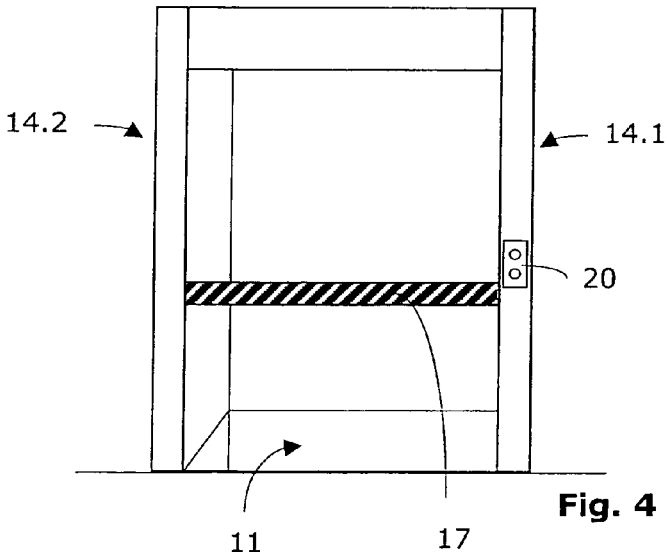
FIG. 4 shows a front perspective view of an opened shaft door exposing the elevator shaft, with a cover according to the present invention can be used as a safety barrier.

In an advantageous embodiment of the present invention the cover 17 is constructed as a safety barrier such that it mechanically secures the shaft door opening when the shaft door has to be opened for checking purposes. For this purpose the cover 17 can be so constructed that after opening and removal it can be positioned horizontally or diagonally transversely in front of the opened elevator shaft 11, as schematically illustrated in FIG. 4. It has the requisite strength for this purpose and is marked with the usual danger colors, wherein these markings are applied in such a manner that they are not visible in the operational position of the cover 17.

In a further form of embodiment the cover 17 is electrically or electromagnetically monitored so that transposition to the service operation takes place automatically when the cover 17 is opened or removed. In addition, the control unit 18 can be automatically lit in this case. The corresponding lighting unit is preferably seated in the door post 14.1 in the chamber 16.

In the case of a further form of embodiment of the present invention the outside opening is disposed in the outer wall 16.1 of the door frame 14. This form of arrangement can be used, for example, in situations in which the floor panel 20 is seated in the wall 10 near the door frame 14.

Further variations are possible with knowledge of the present description. The elevator expert recognizes advantageous embodiments. Thus, he or she monitors, for example, the inside opening 16.21 or the cover 19 by means of, for example, switches or the work surface of the car is formed by the car itself, wherein access to the inside opening 16.21 takes place by means of a part, which can be pivoted away, of the car wall.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A door frame with a control arrangement for an elevator installation with an elevator shaft, comprising:

a door frame element having an internal chamber and an outside opening in a first wall of said door frame element communicating with said chamber, said first wall being exposed at a floor when said door frame element is installed in a shaft door opening of the elevator shaft;

a control unit fixedly mounted in said chamber;

a cover attached to said door frame element in an operating position closing said opening and being movable to a service position permitting access to said control unit in said chamber from the floor for carrying out service operations at said control unit; and said door frame element having a second wall with an inside opening formed therein communicating with said chamber, said second wall facing an interior of the elevator shaft when said door frame element is installed in the shaft door opening of the elevator shaft, said inside opening providing access to said control unit in said chamber from the elevator shaft for carrying out maintenance operations at said control unit.

2. The door frame according to claim 1 wherein said cover remains attached to said door frame element in the service position.

3. The door frame according to claim 1 wherein said cover is demounted from said door frame element in the service position.

4. The door frame according to claim 1 wherein said door frame element is a vertical door frame element of the door frame, said door frame element extending in one of a plane transverse to a door leaf of a shaft door associated with the door frame and a plane parallel to the door leaf.

5. The door frame according to claim 1 wherein said cover in the operating position is flush with an external surface of said first wall.

6. The door frame according to claim 1 wherein said cover is configured to operate as a safety barrier when demounted from said door frame element and mounted in the door frame extending across the shaft door opening.

7. The door frame according to claim 1 including a floor panel attached to said door frame element and extending in a plane transverse to a plane of said first wall.

8. The door frame according to claim 1 wherein said inside opening is larger than said outside opening.

9. The door frame according to claim 1 including a cover closing said inside opening in an operating position and being movable to a maintenance position providing access to said control unit in said chamber, said inside opening cover being formed at least partly from a fire-retardant material or a fire-resistant material.

10. A method for accessing a control unit of an elevator installation wherein the control unit is mounted within a chamber inside a door frame element of a door frame installed in a shaft door opening of an elevator shaft, comprising the steps of:

a) providing an outside opening in a first wall of the door frame element communicating with the chamber, the outside opening being exposed at a floor associated with the shaft door opening;

b) closing the outside opening with a cover movable to a service position providing access to the control unit through the outside opening for carrying out service operations at the control unit; and c) providing an inside opening in a second wall of the door frame element communicating with the chamber and facing an interior of the elevator shaft for carrying out maintenance operations at the control unit.

11. The method according to claim 10 further comprising the steps of:

d) moving an elevator car in the elevator shaft to a position wherein a roof or a work surface of the elevator car is positioned at a working height relative to the control unit;

e) operating the elevator installation to perform at least one of interrupting power to the elevator installation and switching the elevator installation into a service mode;

f) opening door leaves of a shaft door associated with the door frame; and g) performing maintenance on the control unit utilizing an operative on the roof or the work surface of the elevator car accessing the control unit through the inside opening.

12. A door frame with a control arrangement for an elevator installation with an elevator shaft, comprising:

a door frame element having an internal chamber and an outside opening in a first wall of said door frame element communicating with said chamber, said first wall being exposed at a floor when said door frame element is installed in a shaft door opening of the elevator shaft;

a control unit fixedly mounted in said chamber;

a cover attached to said door frame element in an operating position closing said opening and being movable to a service position permitting access to said control unit in said chamber from the floor; and said door frame element having a second wall with an inside opening formed therein communicating with said chamber, said second wall facing an interior of the elevator shaft when said door frame element is installed in the shaft door opening of the elevator shaft, said inside opening providing access to said control unit in said chamber from the elevator shaft and wherein said cover is configured to operate as a safety barrier when demounted from said door frame element and mounted in the door frame extending across the shaft door opening.

* * * * *